US011749168B1

(12) United States Patent
Chang et al.

(10) Patent No.: US 11,749,168 B1
(45) Date of Patent: Sep. 5, 2023

(54) DATA RECEIVER FOR ACHIEVING FUNCTIONS OF LEVEL SHIFTER AND AMPLIFIER CIRCUIT

(71) Applicant: Novatek Microelectronics Corp., Hsinchu (TW)

(72) Inventors: Ho-Chun Chang, Hsinchu (TW); Che-Wei Yeh, Hsinchu (TW); Yu-Hsiang Wang, Hsinchu (TW); Keko-Chun Liang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/857,154

(22) Filed: Jul. 4, 2022

(51) Int. Cl.
*G09G 3/20* (2006.01)

(52) U.S. Cl.
CPC ... *G09G 3/2092* (2013.01); *G09G 2300/0838* (2013.01); *G09G 2310/0289* (2013.01)

(58) Field of Classification Search
CPC ..... G09G 3/2092
See application file for complete search history.

(56) References Cited

U.S. PATENT DOCUMENTS 5,751,627 A * 5/1998 Ooishi ..... G11C 29/789 365/145
6,141,237 A * 10/2000 Eliason ..... G11C 14/0072 365/194
2004/0150607 A1* 8/2004 Nakajima ..... H03K 19/018521 345/100
2005/0190597 A1* 9/2005 Kato ..... G11C 11/22 365/185.08
2008/0224755 A1* 9/2008 Jo ..... G09G 3/20 327/333
2010/0283712 A1* 11/2010 Yen ..... G09G 3/20 345/55
2014/0098017 A1* 4/2014 Murakami ..... G11C 19/28 345/100

* cited by examiner

*Primary Examiner* — William Boddie
*Assistant Examiner* — Andrew B Schnirel
(74) *Attorney, Agent, or Firm* — JCIPRNET

(57) ABSTRACT

The disclosure provides a data receiver, including a first capacitor, a second capacitor, a first inverter and a second inverter. The first capacitor has a first terminal and a second terminal, and the first terminal receives a first input signal. The second capacitor has a third terminal and a fourth terminal, and the third terminal receives a second input signal. The first inverter has a first input terminal and a first output terminal. The second inverter has a second input terminal and a second output terminal. The first input terminal and the second output terminal are coupled to the second terminal of the first capacitor, and the second input terminal and the first output terminal are coupled to the fourth terminal of the second capacitor. The first output terminal generates a first output signal with a first output voltage, and the second output terminal generates a second output signal with a second output voltage.

13 Claims, 7 Drawing Sheets

DATA RECEIVER FOR ACHIEVING FUNCTIONS OF LEVEL SHIFTER AND AMPLIFIER CIRCUIT

BACKGROUND

Technical Field

The disclosure relates to a data receiver, and more particularly to a data receiver for a transmission interface.

Description of Related Art

In many applications, the pre-stage circuit is not able to directly generate common-mode signals suitable for the post-stage circuit due to the limitation of the pre-stage circuit structure or different environmental conditions. When this situation occurs, the first common method is to add a level shifter to the circuit to shift the common-mode level of the signal to the desired level. However, adding the level shifter to the circuit incurs additional costs. The second common method is to add capacitors and a self-biased circuit to the circuit, isolate the pre-stage common-mode level by means of capacitive alternating current (AC) coupling, and then define a new common-mode level with the self-biased circuit. Nevertheless, adding the capacitors and the self-biased circuit to the circuit increases the signal jitter due to the problem of base line wander when the circuit receives random signals, which will make the signal interpretation difficult.

On the other hand, in the common method, if the amplitude of the signals output by the pre-stage circuit is not as expected, an amplifier circuit will be added to the circuit to adjust the signal waveform to meet the design needs. However, this addition of the amplifier circuit results in additional power dissipation.

Accordingly, how to design a data receiver that may receive random or non-random signals without the problem of base line wander and have both the functions of the level shifter and the amplifier circuit is one of the technical subjects studied by people in the field.

Note here that the content in the section of "Description of Related Art" is used to help understand the present disclosure. Part of the content (or all of the content) disclosed in the section of "Description of Related Art" may not be the conventional technology known to those with ordinary knowledge in the art. The content disclosed in the section of "Description of Related Art" does not mean that the content has been known to those with ordinary knowledge in the art before the application of the present disclosure.

SUMMARY

The disclosure provides a data receiver, which may replace the level shifter and the amplifier circuit to generate output signals that meet the requirements including the appropriate common-mode and logic level at one time according to the switching information of random or non-random input signals.

In an embodiment of the present disclosure, a data receiver includes a first capacitor, a second capacitor, a first inverter and a second inverter. The first capacitor has a first terminal and a second terminal, and the first terminal receives a first input signal. The second capacitor has a third terminal and a fourth terminal, and the third terminal receives a second input signal. The first inverter has a first input terminal and a first output terminal. The second inverter has a second input terminal and a second output terminal. The first input terminal and the second output terminal are coupled to the second terminal of the first capacitor, and the second input terminal and the first output terminal are coupled to the fourth terminal of the second capacitor. The first output terminal generates a first output signal with a first output voltage, and the second output terminal generates a second output signal with a second output voltage.

Based on the above, by the AC coupling method of the disclosure, the data receiver can achieve the functions of the level shifter and the amplifier circuit at the same time, and generate the output signals that meet the requirements including the appropriate common-mode and logic level at one time according to the switching information of the input signals. Furthermore, compared with the common AC coupling method, by the AC coupling method of the disclosure, the data receiver can avoid the extra jitter caused by the base line wander phenomenon when inputting random signals.

In order to make the aforementioned features and advantages of the disclosure more comprehensible, embodiments accompanied with drawings are described in detail below.

DESCRIPTION OF THE EMBODIMENTS

Figure 1:
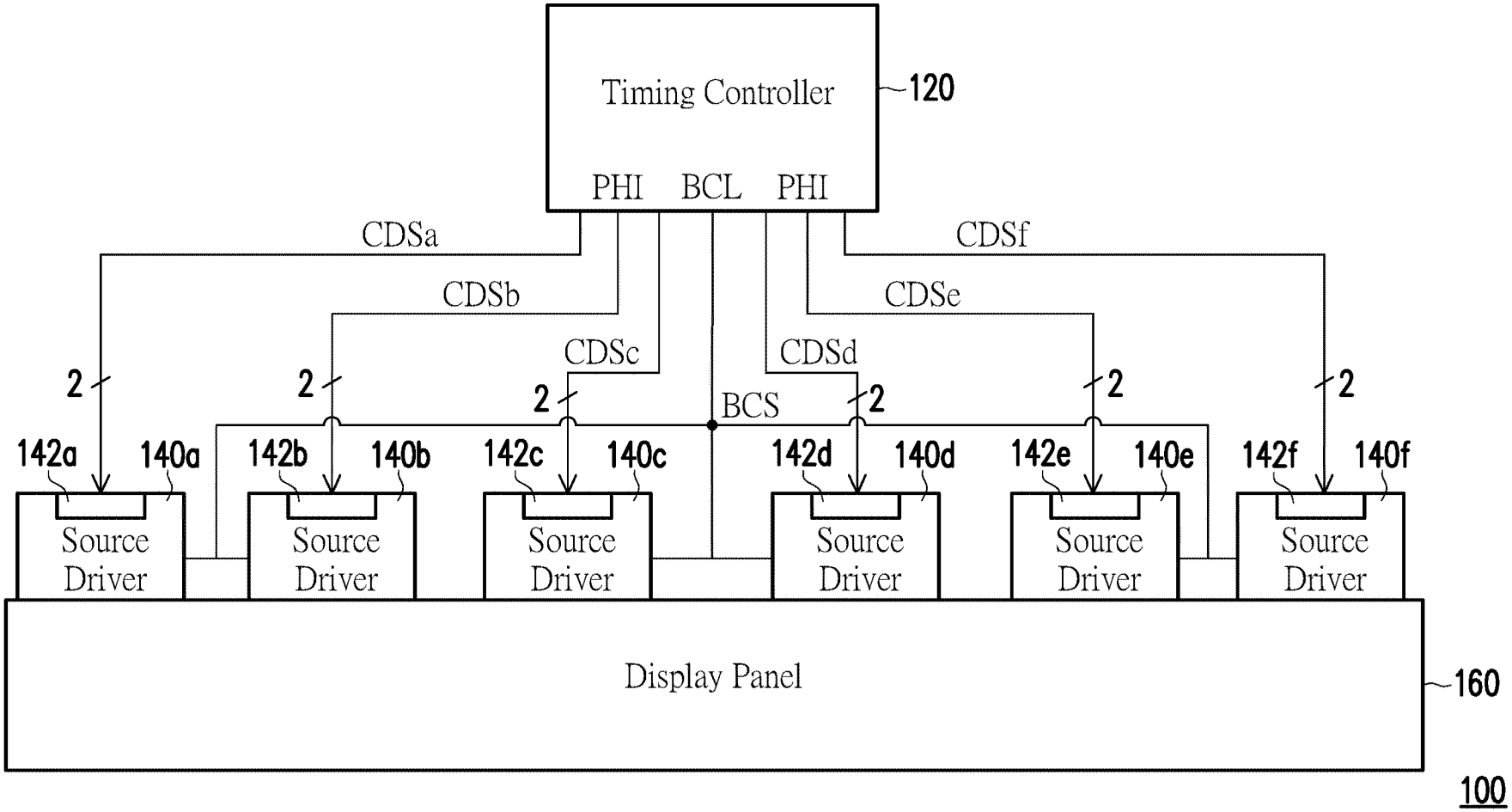
FIG. 1 is a schematic block diagram illustrating a display system 100 according to an embodiment of the present disclosure.

The term "coupling (or connection)" used in the full text of the present application (including the scope of the claims) may refer to any direct or indirect connection. For example, if the text describes that the first device is coupled (or connected) to the second device, it should be interpreted as that the first device is directly connected to the second device, or that the first device is indirectly connected to the second device through other devices or some other connection. The terms "first" and "second" mentioned in the full text of the description of the present application (including the scope of the claims) are used to name the element, or to distinguish between different embodiments or ranges, but are not used to limit the upper or lower limit of the number of elements or the order of components. In addition, wherever possible, elements/components/steps with the same reference numbers in the drawings and embodiments represent the same or similar parts. The descriptions of the elements/components/steps that use the same reference numerals or the same terms in different embodiments may be the mutual references of one another.

FIG. 1 is a schematic block diagram illustrating a display system 100 according to an embodiment of the present disclosure. In the embodiment illustrated in FIG. 1, the display system 100 includes a timing controller 120, a plurality of source drivers 140*a*-140*f* and a display panel 160. In the present embodiment, six source drivers 140*a*-140*f* are illustrated, but the present disclosure is not necessarily restricted thereto.

The timing controller 120 may output a variety of signals including clock-embedded differential signals CDSa-CDSf and a bi-directional control signal BCS to each of the source drivers 140*a*-140*f*. In a bus link as illustrated in FIG. 1, the clock-embedded differential signals CDSa-CDSf may be directly transmitted from the timing controller 120 to each of the source drivers 140*a*-140*f* using point-to-point high-speed interfaces (PHI) respectively, and the bi-directional control signal BCS may be directly transmitted from the timing controller 120 to each of the source drivers 140*a*-140*f* using a bi-directional command link (BCL). In the present embodiment, six clock-embedded differential signals CDSa-CDSf are illustrated, but the present disclosure is not necessarily restricted thereto.

The source drivers 140*a*-140*f* include data receivers 142*a*-142*f* respectively. Each of the source drivers 140*a*-140*f* may receive the corresponding clock-embedded differential signals CDSa-CDSf by the corresponding data receivers 142*a*-142*f* and drive the display panel 160. The details related to the source drivers 140*a*-140*f* driving the display panel 160 are not limited in the present embodiment. Based on a design requirement, for example, the source drivers 140*a*-140*f* may be disposed with conventional source driving circuits or other driving circuits, so as to drive a plurality of source lines (data lines) of the display panel 160. In an embodiment, the display panel 160 may be a liquid-crystal display (LCD) panel, a light-emitting diode (LED) display panel, an organic light-emitting diode (OLED) display panel or any other display panel.

Figure 2:
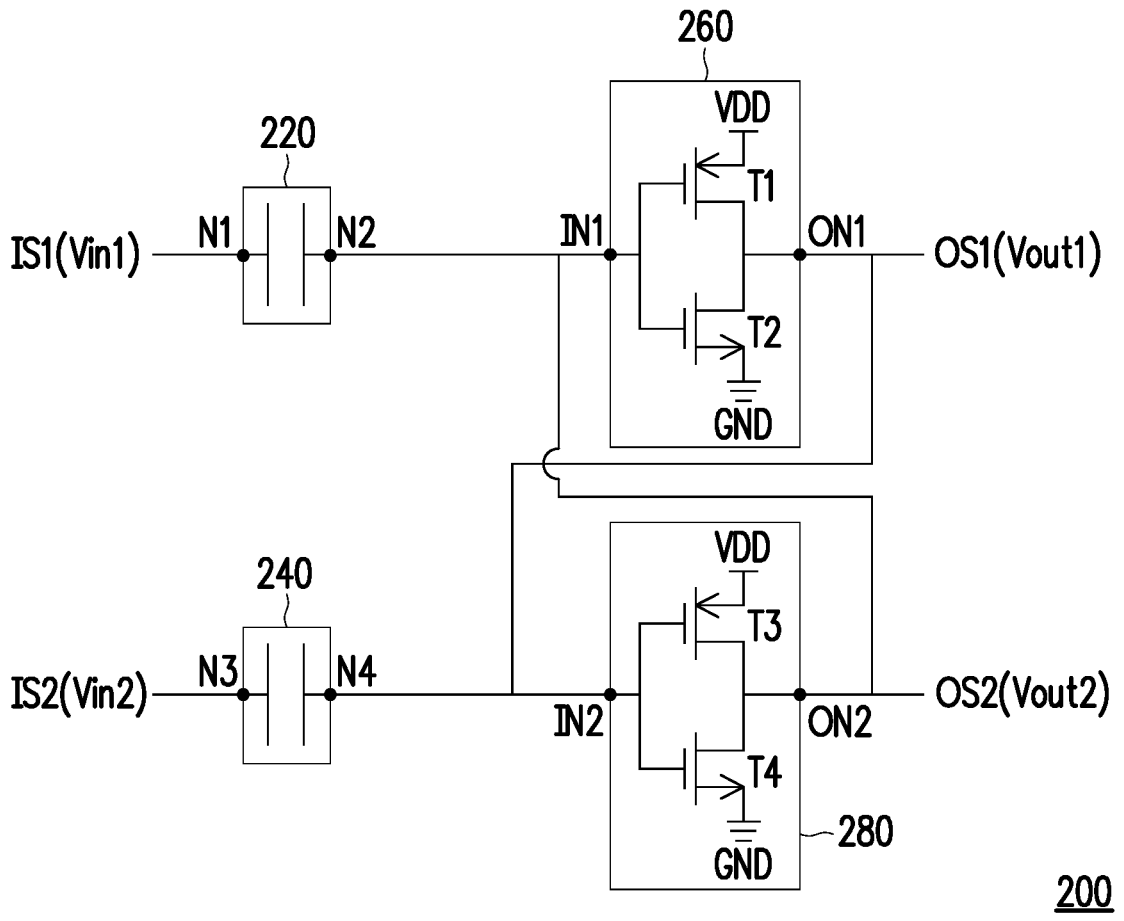
FIG. 2 is a schematic circuit block diagram illustrating any one of the data receivers 142*a*-142*f* depicted in FIG. 1 according to an embodiment of the present disclosure.

FIG. 2 is a schematic circuit block diagram illustrating any one of the data receivers 142*a*-142*f* depicted in FIG. 1 according to an embodiment of the present disclosure. In the embodiment illustrated in FIG. 2, the data receiver 200 includes a capacitor 220, a capacitor 240, an inverter 260 and an inverter 280. The inverter 260 and the inverter 280 latch to each other. In an embodiment, the data receiver 200 may be used for transmission interfaces and data receiving terminals of any application, and the present disclosure is not necessarily restricted thereto.

The detailed description of the connection relationship between the elements in the data receiver 200 is as follows. The capacitor 220 has a terminal N1 and a terminal N2, and the capacitor 240 has a terminal N3 and a terminal N4. The inverter 260 has an input terminal IN1 and an output terminal ON1, and the inverter 280 has an input terminal IN2 and an output terminal ON2. The input terminal IN1 and the output terminal ON2 are coupled to the terminal N2, and the input terminal IN2 and the output terminal ON1 are coupled to the terminal N4.

Specifically, the terminal N1 may receive an input signal IS1 with an input voltage Vin1, and terminal N3 may receive an input signal IS2 with an input voltage Vin2. In an embodiment, the input signal IS1 and the input signal IS2 are a differential pair of signals or any one of the clock-embedded differential signals CDSa-CDSf depicted in FIG. 1. That is, the input signal IS1 and the input signal IS2 have the same voltage amplitude and opposite phases (that is, one is positive and the other is negative). In an embodiment, the input signal IS1 and the input signal IS2 are random or non-random signals, and the present disclosure is not necessarily restricted thereto. Accordingly, the output terminal ON1 may generate an output signal OS1 with an output voltage Vout1, and the output terminal ON2 may generate an output signal OS2 with an output voltage Vout2. It is worth noting that voltage levels of the output voltage Vout1 and the output voltage Vout2 are determined by voltage levels of the input voltage Vin1 and the input voltage Vin2. And the output signal OS1 and the output signal OS2 have the same voltage amplitude and opposite phases.

In an embodiment, the inverter 260 includes a transistor T1 and a transistor T2. A gate of the transistor T1 and a gate of the transistor T2 are coupled to the input terminal IN1. One of a drain and a source of the transistor T1 is coupled to a power supply voltage VDD. One of a drain and a source of the transistor T2 is coupled to a ground voltage GND. The other of the drain and the source of the transistor T1 and the other of the drain and the source of the transistor T2 are coupled to the output terminal ON1. Particularly, the transistor T1 is a PMOS transistor P1, and the transistor T2 is an NMOS transistor N1.

In an embodiment, the inverter 280 includes a transistor T3 and a transistor T4. A gate of the transistor T3 and a gate of the transistor T4 are coupled to the input terminal IN2. One of a drain and a source of the transistor T3 is coupled to the power supply voltage VDD. One of a drain and a source of the transistor T4 is coupled to the ground voltage GND. The other of the drain and the source of the transistor T3 and the other of the drain and the source of the transistor T4 are coupled to the output terminal ON2. Particularly, the transistor T3 is a PMOS transistor P2 and the transistor T4 is an NMOS transistor N2.

Figure 3B:
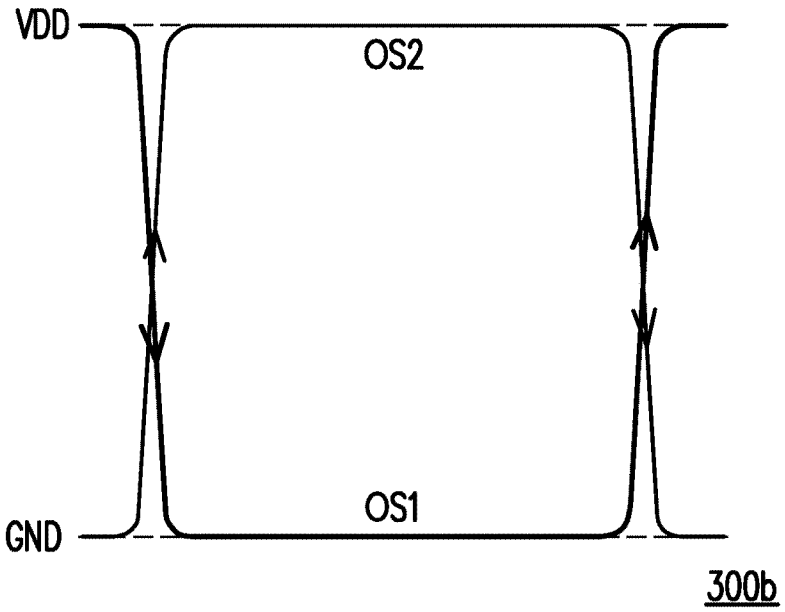
FIGS. 3A and 3B are schematic waveform diagrams illustrating the input signal IS1, the input signal IS2, the output signal OS1, and the output signal OS2 depicted in FIG. 2 according to an embodiment of the present disclosure.
Figure 3A:
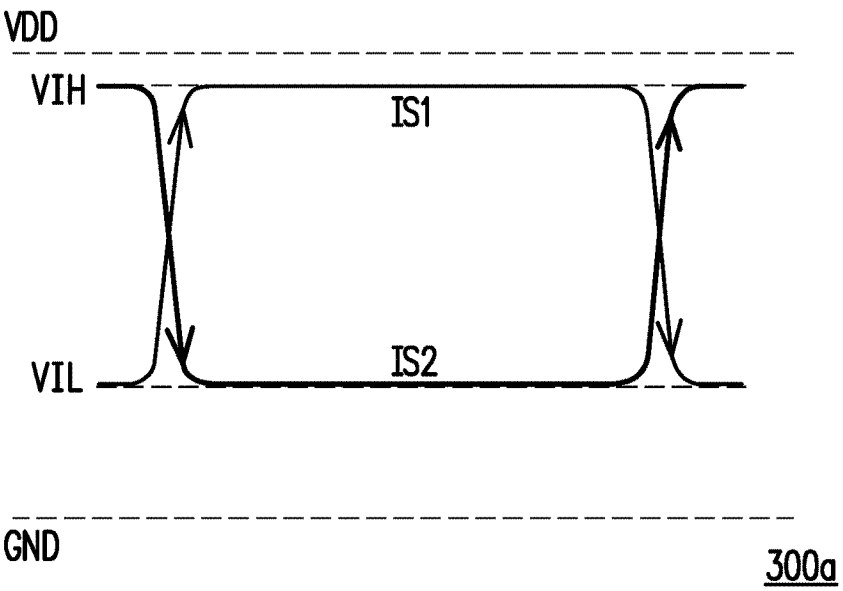

FIGS. 3A and 3B are schematic waveform diagrams illustrating the input signal IS1, the input signal IS2, the output signal OS1, and the output signal OS2 depicted in FIG. 2 according to an embodiment of the present disclosure. In the embodiment illustrated in FIGS. 3A and 3B, there are shown the voltage waveforms 300*a* and 300*b* of the input signal IS1, the input signal IS2, the output signal OS1 and the output signal OS2 before/after the input voltage Vin1 and the input voltage Vin2 are switched.

Please refer to FIGS. 2, 3A and 3B at the same time, the detailed description of the operational relationship between the elements in the data receiver 200 is as follows. When the switching information of the input signal IS1 and the input signal IS2 are received, the output signal OS1 and the output signal OS2 converts to reverse states. For example, when the data receiver 200 receives the switching information of the input signal IS1 and the input signal IS2, the input voltage Vin1 of the input signal IS1 is changed from the logic level VIL to the logic level VIH, and the input voltage Vin2 of the input signal IS2 is changed from the logic level VIH to the logic level VIL. Accordingly, the output voltage Vout1 of the output signal OS1 may be changed from the power supply voltage VDD to the ground voltage GND, and the output voltage Vout2 of the output signal OS2 may be changed from the ground voltage GND to the power supply voltage VDD. For another example, when the data receiver 200 receives the switching information of the input signal IS1 and the input signal IS2, the input voltage Vin1 of the input signal IS1 is changed from the logic level VIH to the logic level VIL, and the input voltage Vin2 of the input signal IS2 is changed from the logic level VIL to the logic level VIH. Accordingly, the output voltage Vout1 of the output signal OS1 may be changed from the ground voltage GND to the power supply voltage VDD, and the output voltage Vout2 of the output signal OS2 may be changed from the power supply voltage VDD to the ground voltage GND.

When the switching information of the input signal IS1 and the input signal IS2 are not received, the output signal OS1 and the output signal OS2 maintain original states. For example, the output voltage Vout1 of the output signal OS1 may maintain the power supply voltage VDD and the output voltage Vout2 of the output signal OS2 may maintain the ground voltage GND. Or the output voltage Vout1 of the output signal OS1 may maintain the ground voltage GND and the output voltage Vout2 of the output signal OS2 may maintain the power supply voltage VDD.

To further illustrate, when the terminal N1 is changed from logic low to logic high, the upward voltage switching signal affects the voltage of the output terminal ON2 to increase upward through the capacitor 220. At the same time, the other terminal N3 of the differential inputs is changed from logic high to logic low, and the downward voltage switching signal causes the voltage of the output terminal ON1 to drop down through the capacitor 240. The high and low relationship between the voltages of the output terminal ON2 and the output terminal ON1 are reversed. The circuit mechanism automatically pulls the voltage of the output terminal ON2 up to the power supply voltage VDD and pulls the voltage of the output terminal ON1 down to the ground voltage GND. And then the circuit locks the voltages of the output terminal ON2 and the output terminal ON1. Now, even if the input signals have no signal switching for a long time, the circuit of the present disclosure may maintain its output state for a long time until the next switching of the input signals occurs. When the next switching of the input signals occurs, the voltages of the output terminal ON2 and the output terminal ON1 will be rewritten through the capacitors. In this way, the data receiver 200 of the present disclosure achieves the effects of level correction, amplitude amplification, common mode level correction and power saving.

Figure 4:
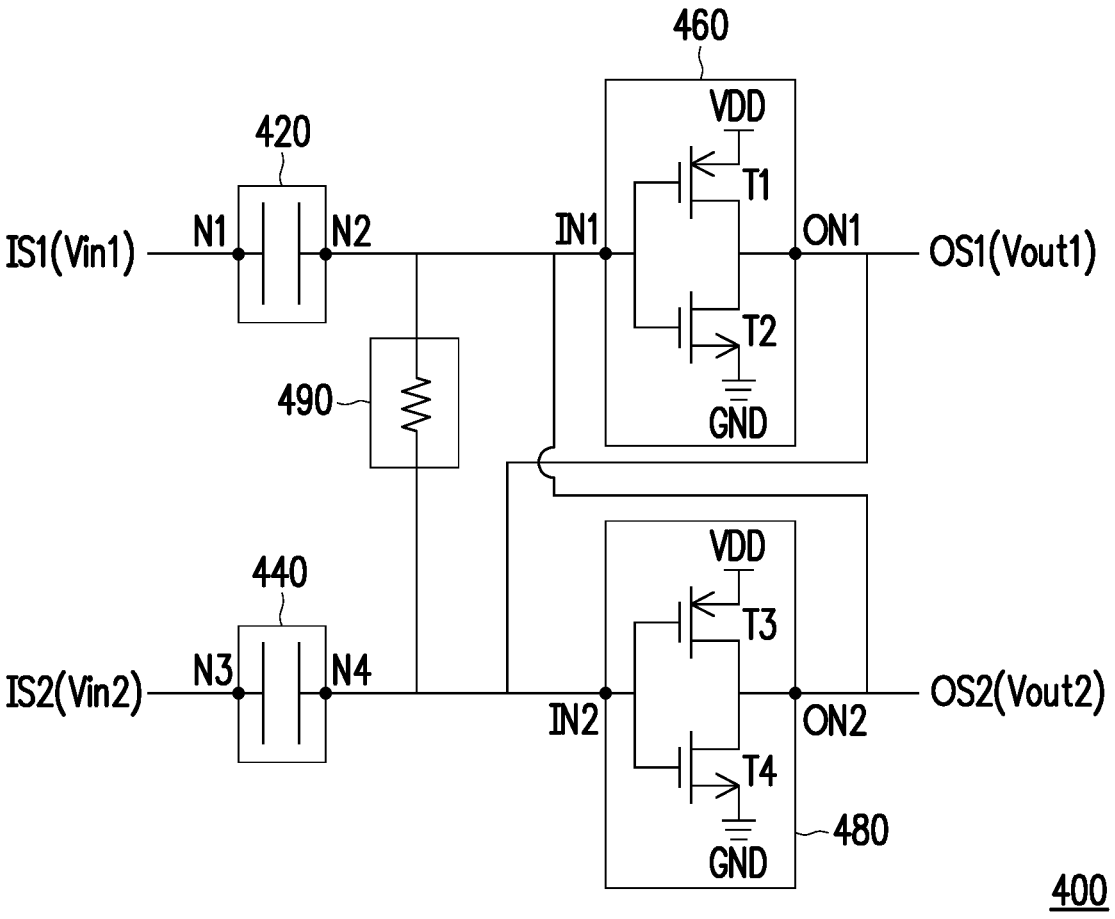
FIG. 4 is a schematic circuit block diagram illustrating any one of the data receivers 142*a*-142*f* depicted in FIG. 1 according to another embodiment of the present disclosure.

FIG. 4 is a schematic circuit block diagram illustrating any one of the data receivers 142*a*-142*f* depicted in FIG. 1 according to another embodiment of the present disclosure. The data receiver 400 depicted in FIG. 4 is similar to the data receiver 200 depicted in FIG. 2, but the data receiver 400 further includes a resistor 490 with a resistance value R. The resistor 490 is coupled between the terminal N2 and the terminal N4. A capacitor 420, a capacitor 440, an inverter 460 and an inverter 480 depicted in FIG. 4 may be inferred with reference to the descriptions related to FIG. 2 and thus, will not be repeated.

In the embodiment illustrated in FIG. 4, the resistor 490 may adjust output swings of the output signal OS1 and the output signal OS2. More specifically, the resistance value R may define the current value between the power supply voltage VDD and the ground voltage GND during operation (referring to FIGS. 5A and 5B, the direction and path of the thick arrow represent the current flow), and then define the logic level VH and the logic level VL of the output signal OS1 and the output signal OS2 when the circuit reaches a steady state. In an embodiment, the logic level VH and the logic level VL are the voltage of logic 1 and the voltage of logic 0 output by the data receiver 400 depicted in FIG. 4.

In an embodiment, when the resistance value R is larger, the current value is smaller. Therefore, the logic level VH is closer to the power supply voltage VDD and the logic level VL is closer to the ground voltage GND. In an embodiment, if the resistance value R is as large as the resistance value of an open circuit (for example, the embodiment of FIG. 2), the output signal OS1 and the output signal OS2 are rail-to-rail signals. Therefore, by controlling the resistance value R, the data receiver 400 may adjust the voltages of the output signal OS1 and the output signal OS2 at the same time.

Figure 5A:
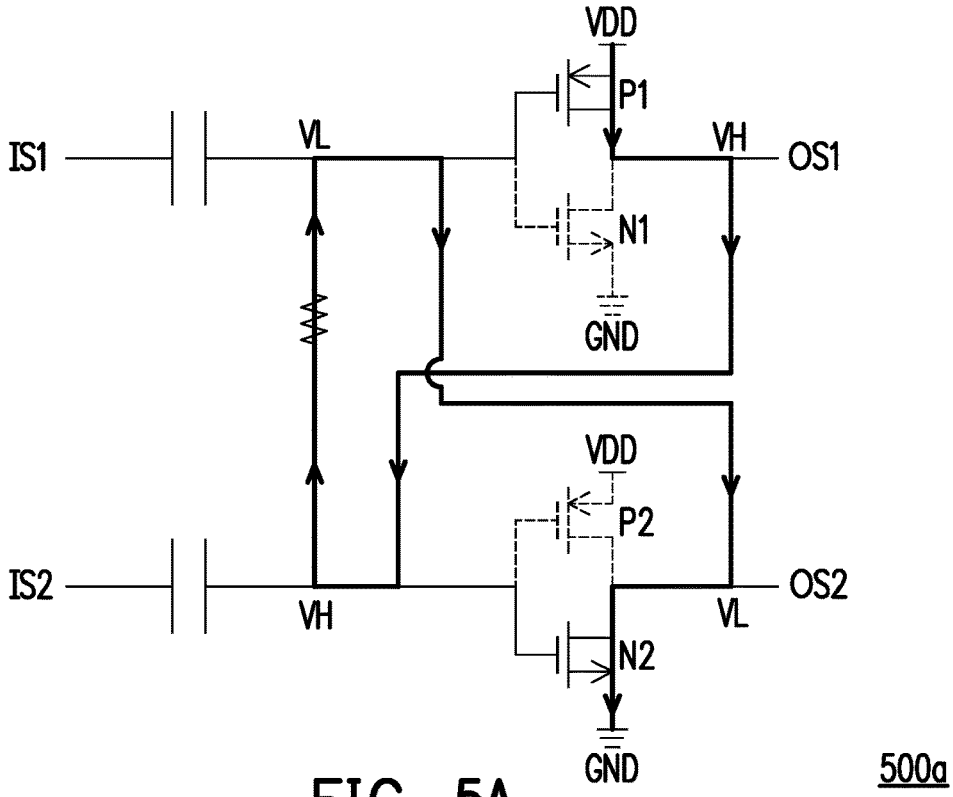
FIGS. 5A and 5B are schematic circuit block diagrams illustrating the current flow of the data receiver 400 depicted in FIG. 4 according to an embodiment of the present disclosure.
Figure 5B:
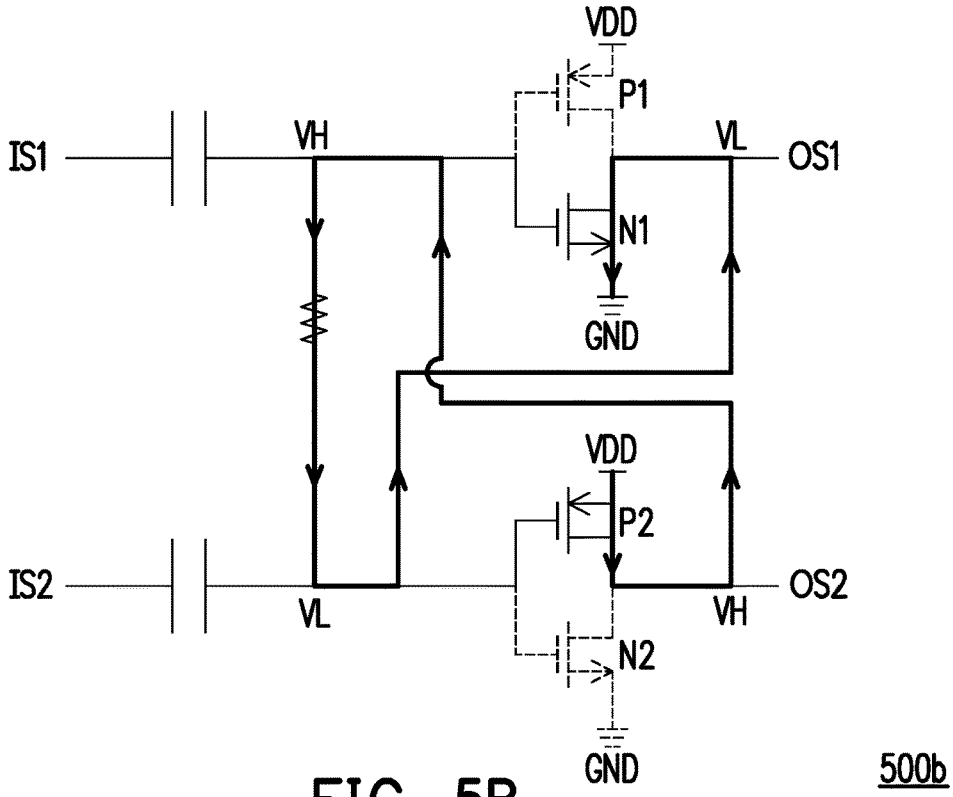

FIGS. 5A and 5B are schematic circuit block diagrams illustrating the current flow of the data receiver 400 depicted in FIG. 4 according to an embodiment of the present disclosure. In the embodiment illustrated in FIGS. 5A and 5B, the direction and path of the thick arrow represent the current flow. FIG. 5A shows the current flow of the data receiver 500*a* when the input voltage Vin1 of the input signal IS1 is the logic level VIL and the input voltage Vin2 of the input signal IS2 is the logic level VIH. FIG. 5B shows the current flow of the data receiver 500*b* when the input voltage Vin1 of the input signal IS1 is the logic level VIH and the input voltage Vin2 of the input signal IS2 is the logic level VIL.

Figure 6B:
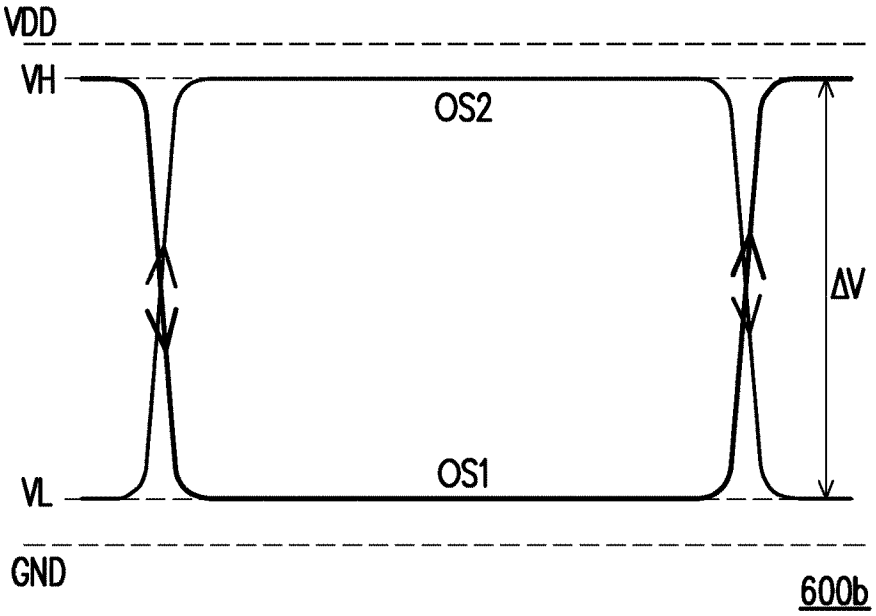
FIGS. 6A and 6B are schematic waveform diagrams illustrating the input signal IS1, the input signal IS2, the output signal OS1, and the output signal OS2 depicted in FIG. 4 according to an embodiment of the present disclosure.
Figure 6A:
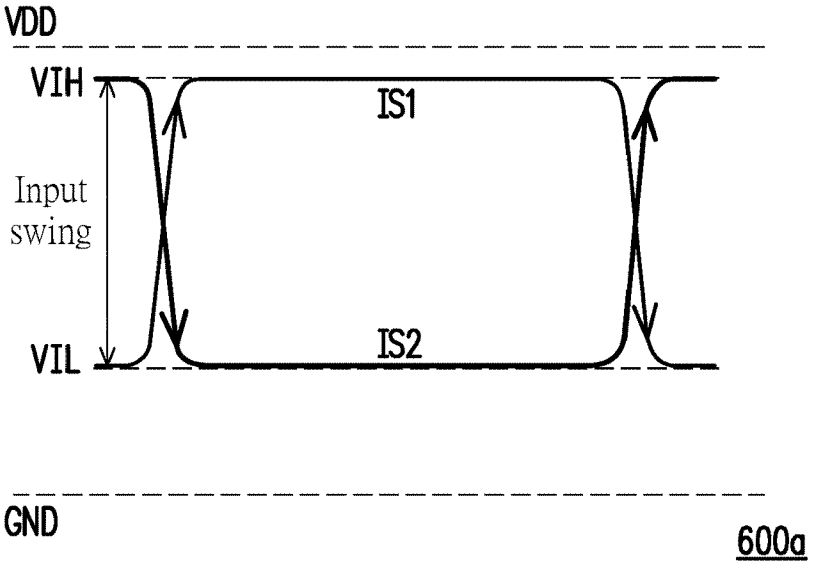

FIGS. 6A and 6B are schematic waveform diagrams illustrating the input signal IS1, the input signal IS2, the output signal OS1, and the output signal OS2 depicted in FIG. 4 according to an embodiment of the present disclosure. In the embodiment illustrated in FIGS. 6A and 6B, there are shown the voltage waveforms 600*a* and 600*b* of the input signal IS1, the input signal IS2, the output signal OS1 and the output signal OS2 before/after the input voltage Vin1 and the input voltage Vin2 are switched.

Please refer to FIGS. 4, 6A and 6B at the same time, the detailed description of the operational relationship between the elements in the data receiver 400 is similar to the detailed description of the operational relationship between the elements in the data receiver 200.

It should be noted that data receiver 400 depicted in FIG. 4 has a minimum input swing requirement under normal operation. The relationship between the resistance value R, the logic level VH, the logic level VL and the input swing requirement is described in detail below.

Figure 7:
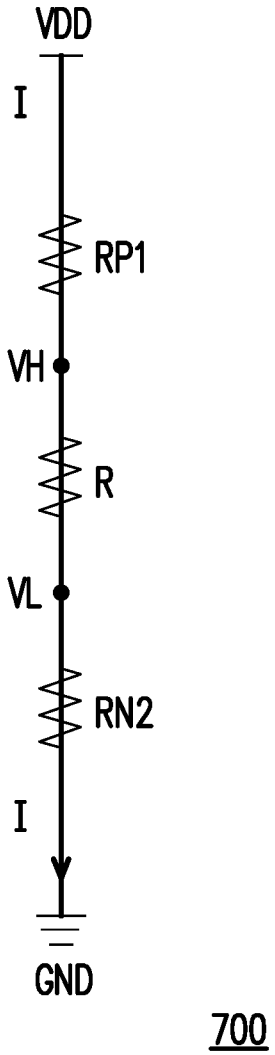
FIG. 7 is a schematic circuit diagram illustrating an equivalent circuit of the data receiver 500*a* depicted in FIG. 5A according to an embodiment of the present disclosure.

FIG. 7 is a schematic circuit diagram illustrating an equivalent circuit of the data receiver 500*a* depicted in FIG. 5A according to an embodiment of the present disclosure. Please refer to FIGS. 5A and 7 at the same time, a PMOS transistor P1 is equivalent to a resistor with a resistance value RP1, and an NMOS transistor N2 is equivalent to a resistor with a resistance value RN2.

In detail, suppose the transistor current formula (triode region) is formula (1) shown below.

$$I=K[(Vgs-Vth)Vds-0.5\times Vds^2]=KVds[[(Vgs-Vth)-0.5\times Vds] \quad (1)$$

In formula (1), K is a constant. It can be observed that Vgs of the PMOS transistor P1 and the NMOS transistor N2 that are turned on in this state are very large, and may be regarded as satisfying $0.5\times Vds \ll (Vgs-Vth)$. Therefore, the current formula may be simplified to formula (2) shown below.

$$I=K[(Vgs-Vth)Vds] \quad (2)$$

Accordingly, the PMOS transistor P1 and the NMOS transistor N2 may be regarded as a resistor with a resistance value of 1/K(Vgs−Vth), i.e. formula (3).

$$RP1=RN2=1/K(Vgs-Vth) \quad (3)$$

Here, the resistance values RP1 and RN2 are shown in formulas (4) and (5) below.

$$RP1=1/K(Vgs-Vth)=1/K(VDD-VL-Vth) \quad (4)$$

$$RN2=1/K(Vgs-Vth)=1/K(VH-Vth) \quad (5)$$

Then, referring to FIG. 7, the current I flowing through the PMOS transistor P1, the resistor 490 and the NMOS transistor N1 is given by the following formula (6). By derivation, the logic level VH is shown in formula (7) below, and the logic level VL is shown in formula (8) below.

$$I=VDD/(RP1+R+RN2) \quad (6)$$

$$VH=I\times(R+RN2)=VDD\times(R+RN2)/(RP1+R+RN2) \quad (7)$$

$$VL=I\times RN2=VDD\times(RN2)/(RP1+R+RN2) \quad (8)$$

Accordingly, the logic level difference ΔV between the logic level VH and the logic level VL is shown in formula (9) below.

$$\Delta V=VH-VL=VDD\times R/(RP1+R+RN2) \quad (9)$$

Assuming that the capacitor and input data transition are ideal and may be coupled to the other terminal of the capacitor without loss, the minimum input swing requirement is half of the logic level difference ΔV. That is, the minimum input swings of the input signal IS1 and the input signal IS2 are greater than or equal to half of the output swings of the output signal OS1 and the output signal OS2. Therefore, theoretically, the minimum input swing must be greater than VDD×R/2(RP1+R+RN2) in order to make the circuit of the data receiver operate normally.

In addition, an equivalent circuit of the data receiver 500*b* depicted in FIG. 5B may be derived by referring to the equivalent circuit of the data receiver 500*a* depicted in FIG. 5A.

In summary, by the AC coupling method of the disclosure, the data receiver can achieve the functions of the level shifter and the amplifier circuit at the same time, and generate the output signals that meet the requirements including the appropriate common-mode and logic level at one time according to the switching information of the input signals. Furthermore, compared with the common AC coupling method, by the AC coupling method of the disclosure, the data receiver can avoid the extra jitter caused by the base line wander phenomenon when inputting random signals.

Although the disclosure has been disclosed by the above embodiments, they are not intterminaled to limit the disclosure. To any one of ordinary skill in the art, modifications and embellishment to the disclosed embodiments may be made without departing from the spirit and the scope of the disclosure. Accordingly, the scope of the disclosure is defined by the claims attached below and their equivalents.

What is claimed is:

1. A data receiver, comprising:

a first capacitor having a first terminal and a second terminal, the first terminal receiving a first input signal;

a second capacitor having a third terminal and a fourth terminal, the third terminal receiving a second input signal;

a first inverter having a first input terminal and a first output terminal;

a second inverter having a second input terminal and a second output terminal; and a resistor, directly connected between the first capacitor and the second capacitor, wherein the first input terminal and the second output terminal are coupled to the second terminal of the first capacitor, the second input terminal and the first output terminal are coupled to the fourth terminal of the second capacitor, the first output terminal generates a first output signal with a first output voltage, and the second output terminal generates a second output signal with a second output voltage.

2. The data receiver according to claim 1, wherein the resistor is coupled between the second terminal and the fourth terminal and configured to adjust output swings of the first output signal and the second output signal.

3. The data receiver according to claim 2, wherein minimum input swings of the first input signal and the second input signal are greater than or equal to half of the output swings of the first output signal and the second output signal.

4. The data receiver according to claim 2, wherein when a resistance value of the resistor is as large as a resistance value of an open circuit, the first output signal and the second output signal are rail-to-rail signals.

5. The data receiver according to claim 1, wherein voltage levels of the first output voltage and the second output voltage are determined by voltage levels of the first input voltage and the second input voltage, and the first output signal and the second output signal have the same voltage amplitude and opposite phases.

6. The data receiver according to claim 1, wherein when switching information of the first input signal and the second input signal are received, the first output signal and the second output signal converts to reverse states.

7. The data receiver according to claim 1, wherein when switching information of the first input signal and the second input signal are not received, the first output signal and the second output signal maintain original states.

8. The data receiver according to claim 1, wherein the first inverter includes a first transistor and a second transistor, a gate of the first transistor and a gate of the second transistor are coupled to the first input terminal, one of a drain and a source of the first transistor is coupled to a power supply voltage, one of a drain and a source of the second transistor is coupled to a ground voltage, and the other of the drain and the source of the first transistor and the other of the drain and the source of the second transistor are coupled to the first output terminal.

9. The data receiver according to claim 8, wherein the first transistor is a PMOS transistor and the second transistor is an NMOS transistor.

10. The data receiver according to claim 1, wherein the second inverter includes a third transistor and a fourth transistor, a gate of the third transistor and a gate of the fourth transistor are coupled to the second input terminal, one of a drain and a source of the third transistor is coupled to a power supply voltage, one of a drain and a source of the fourth transistor is coupled to a ground voltage, and the other of the drain and the source of the third transistor and the other of the drain and the source of the fourth transistor are coupled to the second output terminal.

11. The data receiver according to claim 10, wherein the third transistor is a PMOS transistor and the fourth transistor is an NMOS transistor.

12. The data receiver according to claim 1, wherein the first input signal and the second input signal are random or non-random signals.

13. The data receiver according to claim 1, wherein the first input signal and the second input signal are a differential pair of signals.

* * * * *